US007980029B2

(12) United States Patent
Ahmedy

(10) Patent No.: US 7,980,029 B2
(45) Date of Patent: Jul. 19, 2011

(54) EXTENDIBLE SHELTER

(76) Inventor: Hamidullah Ahmedy, Laval (CA)

( * ) Notice: Subject to any disclaimer, the term of this patent is extended or adjusted under 35 U.S.C. 154(b) by 46 days.

(21) Appl. No.: 12/385,923

(22) Filed: Apr. 24, 2009

(65) Prior Publication Data

US 2010/0269418 A1 Oct. 28, 2010

(51) Int. Cl.

| | |
|---|---|
| ***E04B 1/34*** | (2006.01) |
| ***E04B 1/346*** | (2006.01) |
| ***E04B 7/16*** | (2006.01) |
| ***E04H 1/00*** | (2006.01) |
| ***E04H 15/18*** | (2006.01) |
| ***E04H 15/34*** | (2006.01) |
| ***E04H 15/48*** | (2006.01) |
| ***E04H 15/50*** | (2006.01) |

(52) U.S. Cl. ..... 52/71; 52/2.12; 52/64; 52/73; 52/74; 52/79.6; 135/97; 135/143; 135/144; 135/145; 135/146; 135/121; 135/122

(58) Field of Classification Search ..... 52/2.12, 52/29, 64, 73, 74, 76, 77, 79.6, 222; 135/97, 135/143, 144, 145, 146, 121, 122
See application file for complete search history.

(56) References Cited

U.S. PATENT DOCUMENTS

| | | | | | |
|---|---|---|---|---|---|
| 2,465,551 | A | * | 3/1949 | Otterness | 188/32 |
| 2,603,171 | A | * | 7/1952 | Smith | 52/66 |
| 3,256,896 | A | * | 6/1966 | Cummins | 135/131 |
| 3,424,179 | A | | 1/1969 | Minot | |
| 3,441,037 | A | | 4/1969 | Transeau | |
| 3,729,890 | A | * | 5/1973 | Yamamoto et al. | 52/646 |
| 3,953,051 | A | * | 4/1976 | Weathers | 280/763.1 |
| 3,958,588 | A | | 5/1976 | Huddle | |
| 4,150,682 | A | * | 4/1979 | Ryce | 135/130 |
| 4,667,692 | A | | 5/1987 | Tury et al. | |
| 4,715,077 | A | * | 12/1987 | Shepheard | 14/71.5 |
| 4,844,109 | A | * | 7/1989 | Navarro | 135/129 |
| 5,121,765 | A | | 6/1992 | MacMorris, Jr. | |
| 5,331,777 | A | | 7/1994 | Chi-Yuan | |
| 5,335,684 | A | | 8/1994 | Hanninen | |
| D366,530 | S | * | 1/1996 | Spitz et al. | D25/18 |
| 5,595,203 | A | | 1/1997 | Espinosa | |
| 5,839,462 | A | * | 11/1998 | Randall | 135/128 |
| 5,927,025 | A | * | 7/1999 | Brockman et al. | 52/173.2 |
| 6,230,727 | B1 | * | 5/2001 | Chen | 135/98 |
| 6,260,909 | B1 | * | 7/2001 | Crean et al. | 296/163 |
| 6,550,491 | B1 | * | 4/2003 | Bixler et al. | 135/145 |
| 6,758,230 | B2 | * | 7/2004 | Bogart, Jr. | 135/87 |
| 7,185,667 | B2 | * | 3/2007 | Rottmann | 135/142 |
| 7,290,378 | B2 | * | 11/2007 | Kalnay | 52/641 |
| 7,357,140 | B2 | | 4/2008 | Chu et al. | |
| 7,438,243 | B1 | * | 10/2008 | Erickson | 239/735 |
| 2002/0092552 | A1 | * | 7/2002 | Jones | 135/88.01 |
| 2007/0094941 | A1 | * | 5/2007 | Mintie et al. | 52/63 |

* cited by examiner

*Primary Examiner* — Brian E Glessner
*Assistant Examiner* — Omar Hijaz
(74) *Attorney, Agent, or Firm* — Equinox Protection; Franz Bonsang, Patent Agent

(57) ABSTRACT

An extendible shelter connectable to a building has an extendible frame and a plurality of covers, connected to an outermost frame end, for covering the frame. Adjacent covers are connected to one another at outermost edge ends of their adjacent edges, which are threaded through a fastener. As the frame is extended outwardly away from the building, the adjacent edges are drawn through the fastener, which fastens the edges together to automatically fasten the adjacent covers. When the frame is retracted, the fastener unfastens the edges and covers. Anchor for locking wheels for the frame in fixed position on a ground surface over which the shelter extends are also disclosed.

18 Claims, 5 Drawing Sheets

EXTENDIBLE SHELTER

FIELD OF THE INVENTION

The present invention relates to shelters, and is more particularly directed to an extendible shelter for connection to a building.

BACKGROUND OF THE INVENTION

Extendible shelters for buildings are well known in the art. Such shelters typically have an extendible frame, or truss, and a covering, both of which are connectable on an innermost shelter end of the shelter to the building. The frame and cover, notably outermost ends thereof, are extendible away from and retractable towards the building to enable extension and retraction of the shelter. The outermost end of the shelter typically has an access aperture disposed therein to allow entry and exit from the shelter when extended. The sizes of the shelters are variable and may allow for entry and exit, as well as storage, of equipment or vehicles therein.

For example, U.S. Pat. No. 5,839,462 issued to Randall on Nov. 24, 1998, teaches an expandable shelter having an expandable support frame having a plurality of support sections comprised of side support and upper support members. The side support members of each section are pivotally secured to each other at a lower portion thereof, with upper portions of the side support member rigidly secured to ends of the upper support members, whereby in a retracted position the side support members extend substantially vertical and in an extended position the side support members extend at an acute angle to each other with the upper portions of the side support members spaced apart. A cover, secured to the support sections, connects the upper support members of adjacent support sections and thus provides a roof extending between over the upper support members for the extended position.

As another example, U.S. Pat. No. 4,667,692 issued to Tury et al. on May 26, 1987, teaches an extendible shelter which is quickly erectable by two to six persons, depending upon the size of the shelter. The structure has an extendible frame metal frame with a cover attached to the inside of the frame. The frame comprises a series of ribs, or support members, which can be extended from a compact folded configuration for easy transportation to a full-size shelter at erection. Adjacent ribs are pivotally or slidably connected to one or more connecting members, which serve as force transmitting means for opening and closing the shelter and keeping adjacent ribs stabilized and spaced equidistant. As the ribs are extended relative one another, the cover is extended therebetween to cover the frame on the inside.

Unfortunately, shelters such as those discussed above present a number of disadvantages. Firstly, they may be cumbersome to extend or retract, and may require more than one person to effect extension and retraction thereof. Further, extension and retraction of the cover on the frame may be difficult. In particular, with the cover connected to and extending between each extendible support section, obtaining maximal retraction of the cover for the retracted configuration of the shelter may be difficult.

Accordingly, there is a need for an improved extendible shelter for a building.

SUMMARY OF THE INVENTION

It is therefore a general object of the present invention to provide an improved extendible shelter for a building.

An advantage of the present invention is that the shelter provided thereby can be easily extended and retracted.

Another advantage of the present invention is that the cover of the shelter is automatically extended and retracted with the frame of the shelter.

A further advantage of the present invention is that the cover of the shelter, when the shelter is retracted, is compactly stored proximal the building.

Still another advantage of the present invention is that the shelter may be extended or retracted to extend over a variety of lengths relative the building.

Another advantage of the present invention is that the shelter may be easily and releasably anchored to a ground surface over which the shelter extends.

According to an aspect of the present invention, there is provided an extendible shelter for a building, the shelter comprising:

- a frame connected to the building and extendible and retractable relative thereto, the frame having generally vertical first and second side support sections and a roof support portion section connecting the side support sections;
- a plurality of extendible and retractable covers connected to the building and to an outermost frame end of the frame, at least one cover for each side support section and the roof support section, each cover forming an adjacent cover pair with an adjacent cover, the covers of the cover pairs having generally facing adjacent cover edges;
- a plurality of fasteners, each adjacent pair having a respective fastener, fixedly connecting the covers to one another at respective outermost edge ends of the adjacent cover edges and having the adjacent cover edges threaded therethrough, the fasteners respectively fastening and unfastening the covers pairs to one another as the shelter is, respectively, extended and retracted between an extended configuration therefor, in which the frame is fully extended and covered by the covers fastened to one another along the adjacent cover edges, and a retracted configuration, in which the frame is retracted and the covers are unfastened from one another along the adjacent cover edges. each fastener being a zipper having a respective slider attached to said building and being fixed relative thereto, a respective outer stop connecting said respective outermost edge ends, and respective sets of interlocking teeth extending from said respective outermost edge ends along said adjacent cover edges and threaded through said slider respective sets of interlocking teeth being fastened together and unfastened from one another by said slider by passage therethrough, during, respectively, extension and retraction of said frame and said covers.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
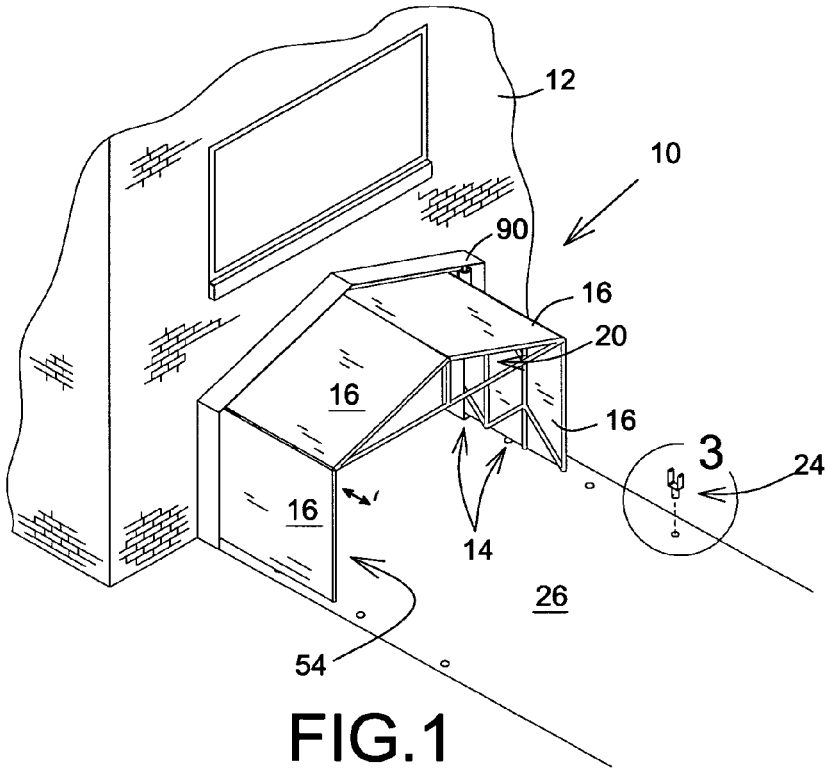
FIG. 1 is a top perspective view of an extendible shelter for a building in accordance with an embodiment of the present invention.
Figure 1A:
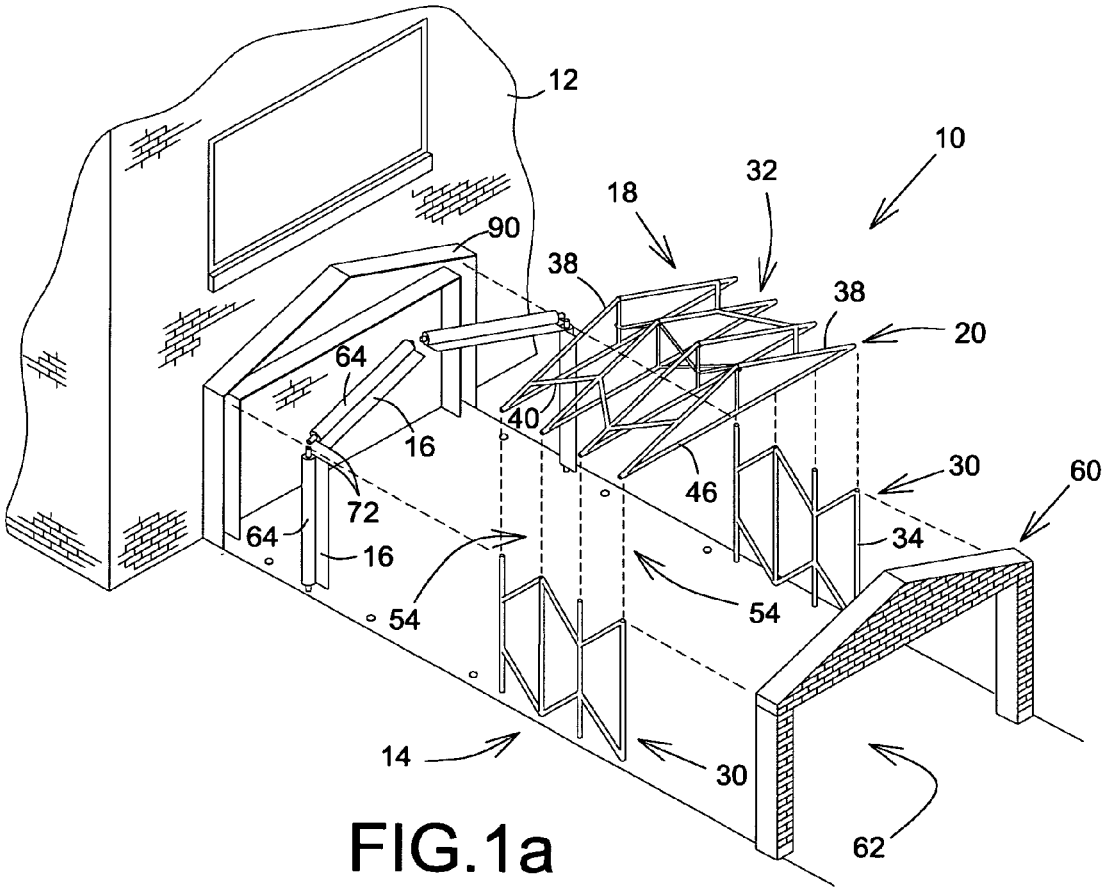
FIG. 1*a* is an exploded view of the extendible shelter shown in FIG. 1, showing an optional outer access structure for the shelter.
Figure 2:
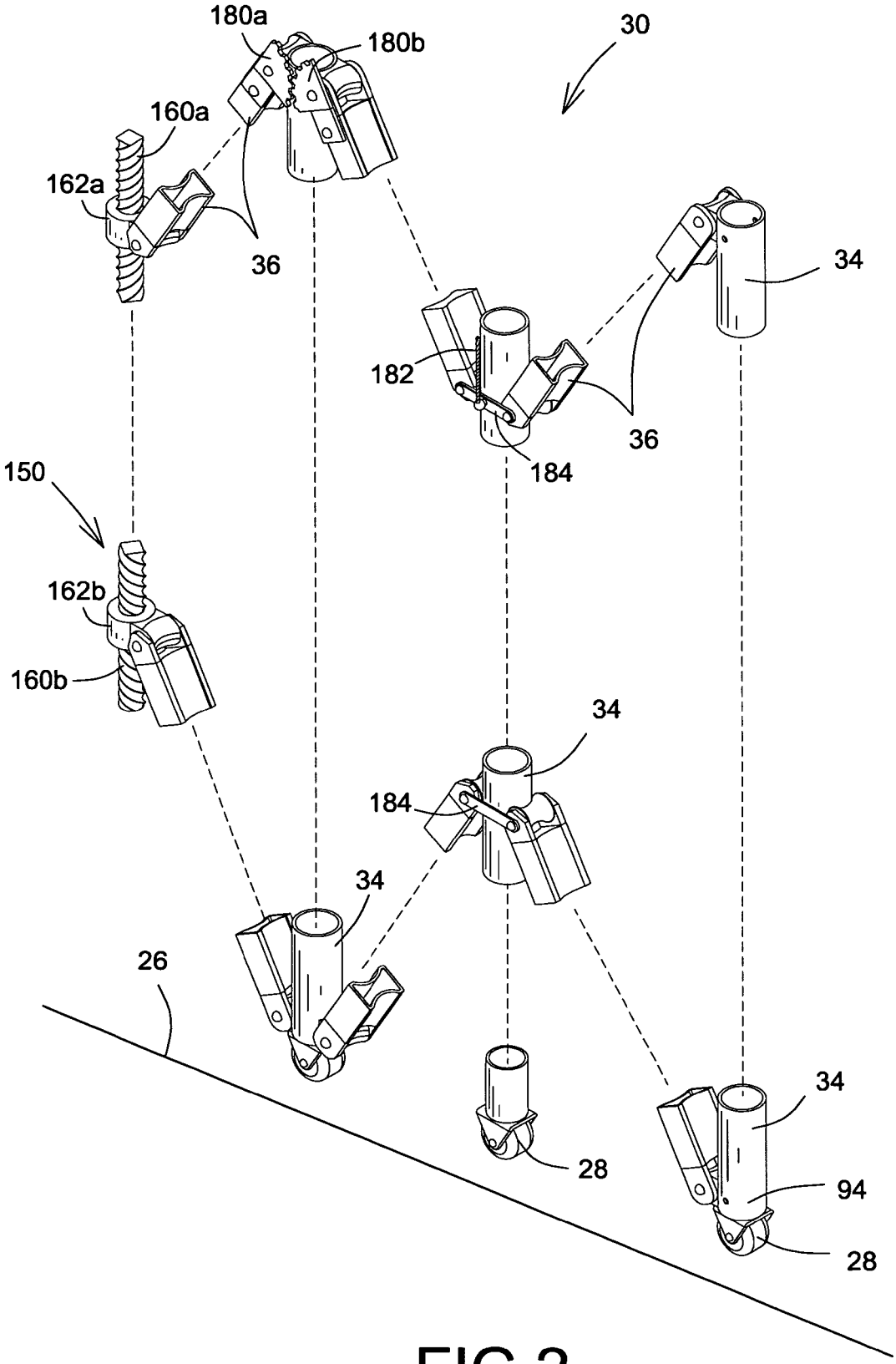
FIG. 2 is an enlarged view of a side support section of a frame for the extendible shelter shown in FIG. 1
Figure 3:
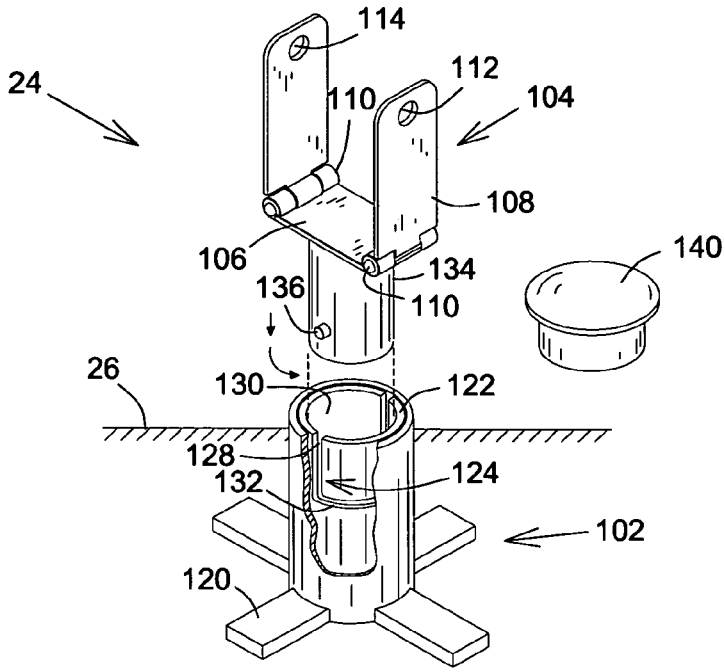
FIG. 3 is an enlarged and exploded view of an anchor for the extendible shelter shown in FIG. 1, taken along line 3-3 thereof.
Figure 4:
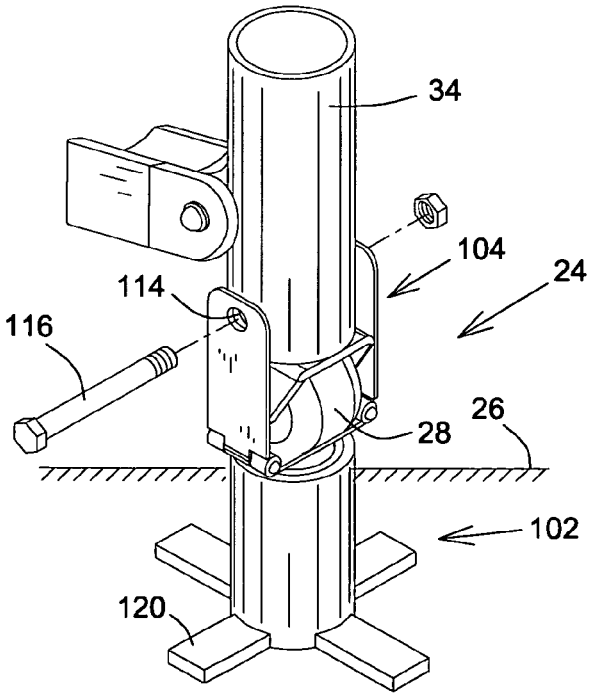
FIG. 4 is an enlarged view of an anchor shown in FIG. 3, illustrating anchoring of a wheel of the shelter therein.
Figure 5:
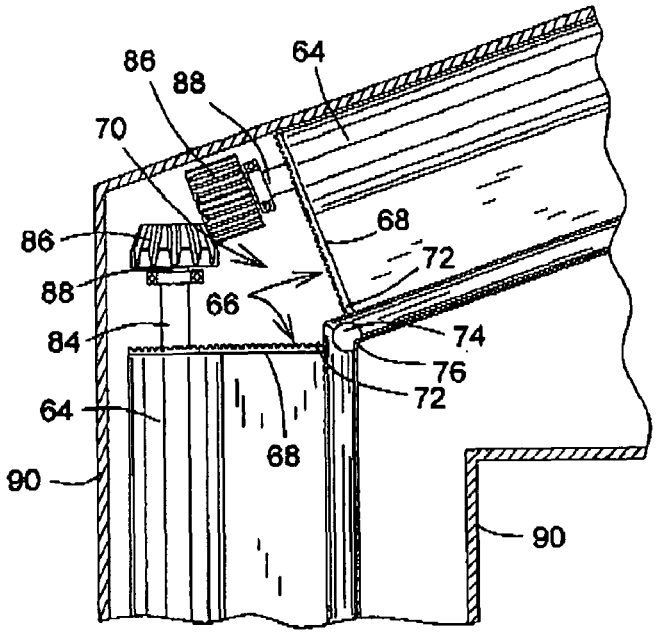
FIG. 5 is an enlarged view of covers and fasteners therefore for the extendible shelter shown in FIG. 1.

Referring to FIGS. 1, 1*a*, 2, 3, 4, 5, 6, and 7 there is shown an embodiment of an extendible shelter, shown generally as 10, for a building 12 in accordance with an embodiment of the present invention. As best shown In FIGS. 1 and 1*a*, the shelter 10 has an extendible and retractable frame, shown generally as 14, a plurality of extendible and retractable covers 16 connected to the building 12 and to the frame 14. The frame 14 is connected to the building on an innermost frame end thereof, shown generally as 18 and situated proximal the building 12, with the covers 16 connected to an outermost frame end, shown generally as 20, situated generally longitudinally opposite the innermost frame end 18 and generally distal the building 12. A plurality of fasteners 70, best shown in FIG. 5, fasten and unfasten adjacent covers 16 as the frame 14 and covers 16 are, respectively, extended and retracted. As best illustrated in FIGS. 3 and 4, anchors, shown generally as 24, are releasably affixable to a ground surface 26 over which the shelter 10 extends and are configured for anchoring wheels 28 of the frame 14, and thereby the frame 14 and shelter 10, to the ground surface 26 as explained in further detail below.

Referring now to FIGS. 1, 1*a*, 2, and 7, the frame 14 has generally opposed first and second side support sections, shown generally as 30, and at least one roof support section, shown generally as 32 and connecting the side support sections 32, the sections 30, 32 defining the overall shape of the shelter 10 and supporting the covers 16 when extended along therewith. More specifically, the first and second side support sections 30, best shown in FIG. 2, are disposed generally vertically, and preferably perpendicularly, relative the ground surface 26. The roof support sections 32, best shown in FIG. 7, connect the first and second side support sections 30 and extend generally horizontally over the ground surface 26.

More specifically, and referring now to FIGS. 1, 1*a*, and 2, each side support section 30 has a plurality of generally vertical side support members 34, with adjacent side support members 34 being connected to one another by side cross support members 36. Adjacent side cross support members 36 are movable, and preferably pivotally and slidably movable, outwardly away from and inwardly towards at least one vertical side support member 34 connected thereto to enable movement of the side support members 34 away from and inwardly towards the building 12. Similarly, and referring to FIGS. 1, 1*a*, and 7 each roof support section 30 has a plurality of roof support members 38 which are connected to at least one side support section 30, preferably the vertical side support members 36 thereof, and extend therefrom towards the other side support section 30. The outermost side support members 34 and outermost roof support members 38 connected thereto generally define the outermost frame end 20, situated distal the building. The innermost side support member 34, dual threaded side support member 150, and innermost roof support members 38 define innermost frame end 18, generally opposite the outermost frame end 20 and situated proximal the building 12 and connected thereto. As the shelter 10 is extended and retracted, the outermost frame end 20 and covers 16 connected thereto are respectively, extended away from and retracted back towards the building 12 and the innermost frame end 18. The outermost frame end 18 also defines an outermost frame aperture 54, which provides access, notably ingress and egress into the frame 14 at the outermost frame end 20. The innermost frame end 18 may, optionally, define an innermost frame aperture, not shown, to provide ingress and egress therethrough to and from building 12.

Optionally, the shelter 10 may also include a fixed outer access structure or frame, shown generally as 60 in FIG. 1*a*, which is affixed to the frame 10 at the outermost frame end 20. In such case, the outer access structure 60 and the outermost frame end 20 and cover 16 are size and shaped, along with structure 60, such that the cover 16 and frame 14 at outermost frame end 20 are covered by a portion of the structure 60. Accordingly, the structure 60 is preferably similar in size and shape to the frame 16, notably the outermost frame end 20 thereof. An outer access aperture 62, preferably similar in size and shape to the outermost frame aperture 54, provides ingress and egress therethrough into the shelter 10.

Referring again to FIG. 7, preferably, but optionally, adjacent roof support members 38 are connected to one another by roof cross support members 40 extending between the roof support members 38. Each roof cross support member 40 is movable, and preferably pivotally and slidably movable, outwardly away from and inwardly towards at least one roof support member 38 connected thereto to enable movement of the roof support members 38 outwardly away from and inwardly towards the building 12 during, respectively, extension and retraction of the frame 14.

Referring to FIGS. 1, 1*a*, 2 and 7, the frame 14 preferably has first and second roof support sections 32, each roof support section 32 connected to one side support section 30 and slanting upwardly therefrom and connecting to the other roof support section 32, forming a roof apex 44 at an intersection therewith. In such case, each roof support member 38 extends slantingly upwardly from a side support member 36 connected thereto on one side support section 30 and connects with another roof support member 36, forming a roof connector pair therewith, similarly connected to a generally aligned side support member 34 from the other side support section 30. The side support members 34 are generally aligned with one another relative the building 12, as are the roof connector pair. The apex 44 is formed at the intersection between the two roof support members 38. For additional support, the roof support section 32 may have a roof connector member 46 extending underneath each roof connector pair of roof support members 38 and connecting the roof support members 38 at their respective intersections with the side support members 34. To provide additional support, there is preferably, for each roof connector member 46, an intermediate connector member 48 extending, preferably perpendicularly, vertically upward from the roof connector member 46 to the apex 44 of the roof connector pair of roof support members 38 extending thereabove. Optionally, adjacent intermediate connector members 48 may be connected to one another and to adjacent roof connector members 46 via lateral connecting members 52 or brackets which are slidably and pivotally connected to at least one intermediate connector member 48 and a roof connector member 46 such that a roof connector member 46 and intermediate connector member 48 connected thereby may move away from and back towards the building 12 during extension and retraction of the shelter 10. Members 34, 36, 38, 40, 46, 48, 52 of frame 14 are preferably made of a sturdy lightweight metal, but may be constructed of any rigid material, for example plastic or wood, capable of supporting the covers 16 when supported by and extended on the frame 14.

Referring again to FIGS. 1, 1*a*, and 5, with regard to the covers 16 and fasteners 22, there is at least one cover 16 for each side support section 30 and each roof support section 32, preferably one cover 16 for each section 30, 32 and connected to the outermost frame end 20. Specifically, covers 16 for side support sections 30 are connected to notably outermost side support members 34 and covers 16 for roof support sections 32 are connected to outermost roof support members 38. Each cover 16 is further connected to the building 12, notably as a respective roll or spool 64 rotatably mounted on a spool member 84 rotatably mounted on or proximal to the building 12. The cover 16 is connected to the spool 64 and is rotatably wound therearound, thus allowing the cover 16 to be extended and retracted by, respectively, rolling the cover 16 outwardly off and inwardly back on to the spool 64 during extension and retraction of the shelter 10.

Covers 16 for adjacent side and roof support sections 30, 32 and mounted on adjacent spools 64 form adjacent cover pairs 66 of covers 16 having generally facing adjacent cover edges 68. Each adjacent cover pair 66 of covers 16 has a respective fastener, exemplarily and generally shown as a conventional zipper 70, fixedly connecting the covers 16 of the adjacent cover pair 66 at respective outermost edge ends 72 of the adjacent cover edges 68. For example, and as shown, the outermost edge ends can be connected by a respective outer stop 76 of the zipper 70. The adjacent edges 68 are threaded through the fastener 70, for example a slider 74 of the zipper 70 fixedly disposed in fixed position intermediate the spools 64 of the adjacent cover pairs 66 and between the outer stop 76 and the spools 64.

The fastener 70, notably the slider 74 of each zipper 70, connects and disconnects the adjacent cover edges 68 as the adjacent covers 16 are, respectively, extended and retracted by extension and retraction of the frame 14, and notably the outermost frame ends 20 to which the covers 16 are connected, away from and towards the building 12. Thus, the covers 16 of adjacent cover pairs 66 are, respectively automatically fastened and unfastened by extending and retracting the frame 12, and thereby the covers 16 extending thereover and connected to the outermost frame end 20, away from and towards the building 12. In other words, the covers 16 are automatically fastened and unfastened during their extension and retraction along with the frame 12 as the shelter 10 is moved between a retracted configuration, in which the outermost frame end 20 and outermost edge ends 72 are adjacently proximal the building 12 and the innermost frame end 18, and an extended configuration in which the outermost frame end 20 and outermost edge ends 72 are comparatively distal the building 12 and the innermost frame end 18. More specifically, and as shown, the adjacent cover edges 68 have sets of interlocking zipper teeth 78 extending on each adjacent edge 68 and which are releasably fastened and unfastened by the sliders 74 as the frame 14 and covers 16 are, respectively, extended and retracted. To ensure uniform extension and retraction of the adjacent covers 16, the spool members 84 for the adjacent spools 64 have interconnecting spool member gears 86 on adjacent spool members ends 88 that engage each other as the covers 16 are extended and retracted.

While the fastener 70 shown is a conventional zipper 70, other devices could be deployed as fasteners 70, such as slide lock devices or the like, provided the device can automatically fasten the adjacent covers 16 during extension and retraction of the covers 16 with frame 14. The covers 16 are preferably made of a water resistant sturdy textile material to prevent passage of precipitation into the shelter 10. A housing 90 connected to the building 12 extends outwardly therefrom and extends over the spools 64, the innermost frame end 18, and extension mechanism to protect them from precipitation or the like and to minimize passage of precipitation between the innermost frame end 18 of the frame 14 and the building 12.

To facilitate extension and retraction of the frame 14, and thereby the shelter 10, at least one side support member 34 on each side support section 30 is configured for mounting of a respective wheel 28 at a bottom end 94 of the member 34. Preferably, wheels 98 are mounted in wheel pairs on member pairs of generally aligned side support members 34. Preferably, at least one such wheel pair is mounted on the outermost side support members 34 at the outermost frame end 20 and adjacent the outer access structure 60, when present.

Reference is now made to FIGS. 1, 1*a*, 3, and 4, wheel anchors 24 are releasably affixable to the ground surface 26 and hold the frame 12, and thereby the shelter 10, in fixed position relative the building 12 on the ground surface 26, by releasable connection of the wheels 28 thereto. Preferably, there is at least one anchor pair of generally aligned wheel anchors 24 for ensuring that at least one wheel pair of wheels 28 can be releasably anchored in position by releasably connecting each wheel 28 to a wheel anchor 24.

The wheel anchors 24 have an anchor base, generally 102, releasably affixable to the ground surface 26, and a wheel anchor lock, generally 104, which is releasable connectable to the wheel anchor base 102 and in which the wheel 24 is releasably securable. The wheel anchor lock includes a base plate 106 and first and second side plates 108 pivotally, and preferably hingedly, connected to the base plate 106 at first and second base plate ends 110. Each side plate 108 is pivotable relative the base plate 106 to axially align respective plate securing apertures 112, one on each side plate 108, with generally opposed and axially aligned member securing apertures 114 proximal the bottom end 94 of the side support member 34 with the wheel 28 disposed between the side plates 108 below the apertures 112, 114. A securing member 116, such as a bolt or locking pin of the like, may then be removably inserted into and through the apertures 112, 114 to releasably connect the side plates 108 to the side support member 34 and secure the wheel 28 within the wheel anchor lock 104, preferably with the wheel 24 seated on the base plate 106.

The anchor base 102 has a socket base 120 and a socket 122 extending generally perpendicularly away therefrom, the socket base 120 being releasably affixable to the ground surface 26. The socket 122 has at least one L shaped groove 124 or slot formed in an inner wall thereof. The slot 124 has an upper portion 128, axially aligned with the socket 122 and extending from a mouth 130 thereof, and an intersecting lower portion 132 extending generally perpendicularly from the upper portion 128. A locking member 134 of the anchor lock 104 extends generally perpendicular the base plate 106 and is releasably insertable into the socket 122. More specifically, the locking member 134 has, for each slot 124, at least one notch 136 protruding therefrom and configured for insertion into the upper portion 128 of the slot 124 as the locking member 134 is being inserted into the socket 122 through the mouth 130. The member 134 may be turned or rotated to move the notch into the lower portion 132 to releasably lock the locking member 134 in the socket 122 and releasably connect the anchor lock 104 to the anchor base 102. An optional cap 140 may be placed in the mouth 130 to close socket 122 when the anchor 24 is not in use.

Figure 6:
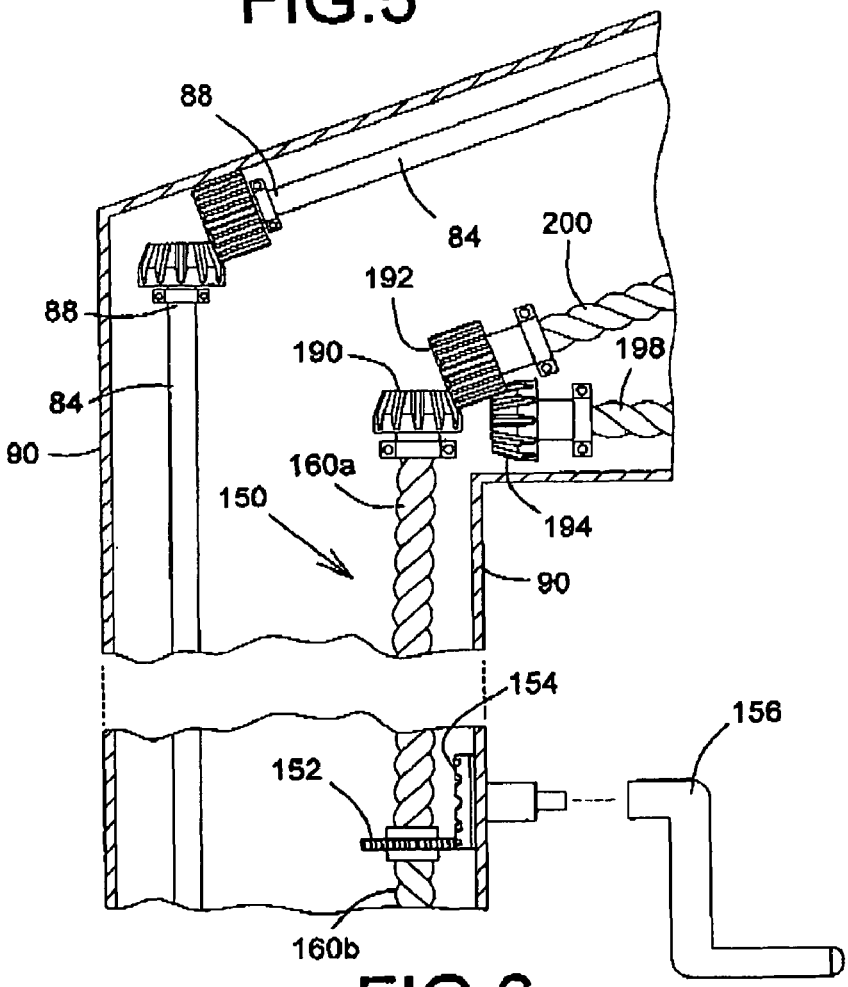
FIG. 6 is a cross sectional view of the extendible shelter of FIG. 1, showing a gear framework for extension and retraction of the shelter.
Figure 7:
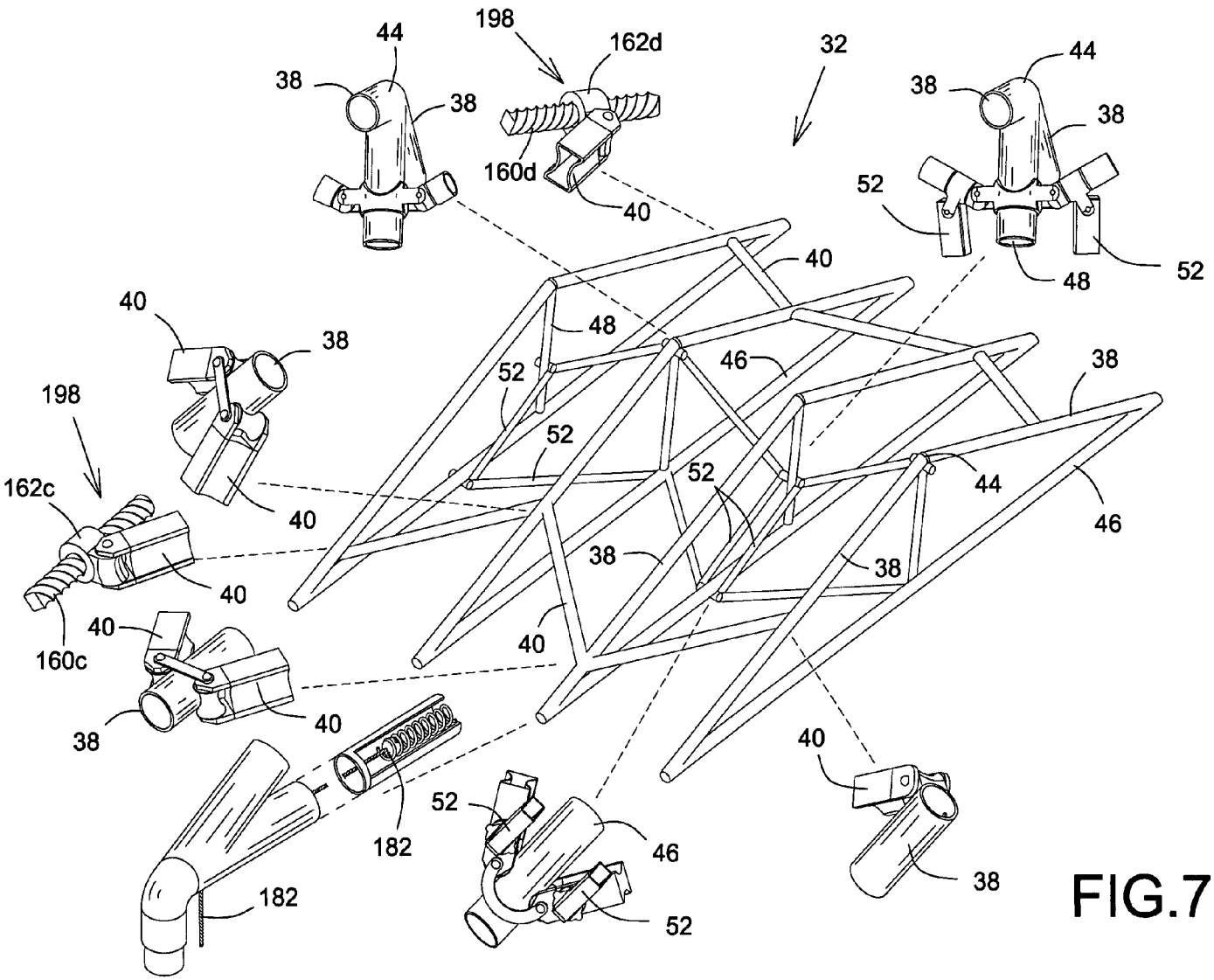
FIG. 7 is an enlarged view of a roof support section of the frame for the extendible shelter shown in FIG. 1.

Extension and retraction of the frame 14 and covers 16, via extension and retraction of members 36, 38, and 40, may be accomplished by any method or means known in the art. However, for purposes of demonstration only, an example of a possible extension means or system deployable with the shelter 10 is illustrated by FIGS. 2, 6, and 7. As shown in FIGS. 2 and 6, the innermost frame end 18 has a double threaded support member 150, with first and second sets of threads 160, the first set of threads 160 extending in one direction and the second set of threads 160 extending in a generally opposite direction. A first drive gear 152 mounted thereon on the double threaded side support member 150 cooperates with a second drive gear handle connected to handle 156 and causes the double threaded side support member 150 to rotate in generally opposed first and second rotation directions as the handle is rotated, respectively, in generally opposed first and second handle directions. The first set and second set of threads 160 have, respectively, first and second brackets 162*a*, 162*b* mounted thereon, and connected to the innermost side cross support members 36. As the handle is rotated in first handle direction to rotate the member 150 in first rotation direction, the first and second sets of threads 160*a*, 160*b* cause first and second brackets 162 to move in opposite directions, the first bracket 162*a* moving upwardly and the second bracket 162 moving downwardly 162*b*. The brackets 162 move in the opposite directions, i.e. the first bracket 162*a* downwardly and the second bracket 162*b* when the handle 156 is turned in the second handle direction. As the first bracket 162*b* moves upwardly, it forces the innermost cross side support member 36 to move outwardly way form the building 12. At the same time, the upwards motion of the bracket 162*a* causes a first side member gear 180*a* at the distal end of the innermost cross side support member 36 to rotate downwardly, causing a second side member gear 180*b* connected thereto to rotate downwardly and force the side cross support member 36 connected thereto to extend outwardly while a resilient spring or biasing means 182 pulls slidable connector bracket 184 upwardly on the side support member 34. The slidable connector bracket 184 connects the cross side support members 36 on the side support member and, as it moves upwardly, causes the outermost cross side support member 38 to extend outwardly and move the outermost side support member 34 at the outermost frame end 20 outwardly away from the building 12. As the outermost frame end 20 is extended away from the building 12, the covers 16 are extended and automatically fastened to one another, as previously described. At the same time, the outwards motion of the cross side support members 36, along downward motion of second bracket 162*b*, proximal the top of the side support members 36 also forces the cross side support members 36 proximal the bottoms ends 94 to extend outwardly. When the handle 156 is rotated in the second handle direction, the process is reversed. Typically, there will be alternating sets of gears 180 and slidable connector brackets 184, possibly with additional biasing means 182, on the side support members 34 except for the outermost side support member 34.

Optionally, but preferably, the frame 14 also provides for extension and retraction of the frame 14 in the roof support section 32. To this end, the uppermost end of the double threaded member 150 has a first end gear 190 which cooperates with second and third ends gears 192, 194 connected to double threaded roof support member, generally shown as 198, and drive member 200. The double threaded roof support member 198, having oppositely threaded third and fourth sets of threads 160*c*, 160*d* with, respectively, third and fourth brackets 162*c*, 162*d* mounted thereon, the brackets 162*c*, 162*d* moving in opposite directions, generally inwardly towards one another, as the double threaded roof support member 198 is rotated in first rotation direction by the action of the handle 156, member 150, and gears 190, 192, 194. As the brackets 162*c*, 162*d* move inwardly, they force the innermost cross roof support members 40 to extend outwardly, which in turn, along with biasing means draws connector brackets 184 on roof cross support members 40 inwardly to force the outermost roof cross support members 40 away from the building and extend the outermost frame end 20 of the roof support section 32 away from the building 12. Turning the handle 156 in the second handle direction reverses this process during retraction of the frame 14. Lateral connecting members 52 are slidably connected to intermediate connector members 48 and/or roof connector members 46, and are accordingly drawn outwardly or retracted inwardly by the extension and retraction of the roof cross support members 40.

Although the present shelter 10 has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. An extendible shelter for a building, said shelter comprising:

a frame connected to the building and extendible and retractable relative thereto, said frame having generally vertical first and second side support sections and a roof support portion section connecting the side support sections;

a plurality of extendible and retractable covers connected to the building and to an outermost frame end of the frame, at least one cover for each side support section and said roof support section, each cover forming an adjacent cover pair with an adjacent said cover, said covers of said cover pairs having generally facing adjacent cover edges;

a plurality of fasteners, one-fastener for each adjacent cover pair, fixedly connecting said covers of said pair to one another at respective outermost edge ends of said adjacent cover edges and having said adjacent cover edges threaded therethrough, said fasteners respectively fastening and unfastening said covers of said cover pairs to one another as said shelter is, respectively, extended and retracted between an extended configuration therefor, in which said frame is fully extended and covered by said covers fastened to one another along said adjacent cover edges, and a retracted configuration, in which said frame is retracted and said covers are unfastened from one another along said adjacent cover edges, each fastener being a zipper having a respective slider attached to said building and being fixed relative thereto, a respective outer stop connecting said respective outermost edge ends, and respective sets of interlocking teeth extending from said respective outermost edge ends along said adjacent cover edges and threaded through said slider, said respective sets of interlocking teeth being fastened together and unfastened from one another by said slider by passage therethrough, during, respectively, extension and retraction of said frame and said covers; and wherein said covers are rotatably mounted on respective spools therefore connected to the building, said covers being rolled outwardly off and inwardly back on the respective spools during, respectively, extension and retraction of said shelter; and wherein said spools are mounted on respective spool members therefor, said respective spool members for said respective spools of each respective cover pair having interconnecting spool member gears on respective adjacent spool member ends thereof, said interconnecting spool member gears engaging one another as said covers are retracted and extended with said frame to ensure uniform extension and retraction of said covers.

2. The extendible shelter of claim 1, wherein said outermost frame end and said outermost edge ends are disposed adjacently proximal said building in said retracted configuration and distal said building in said extended configuration.

3. The extendible shelter of claim 1, further comprising a housing connected to said building and extending outwardly therefrom, said housing extending over said spools and an innermost frame end of said frame, said innermost frame end disposed opposite said outermost frame end.

4. The extendible shelter of claim 1, wherein said outermost frame end defines an outer frame aperture for enabling access to the shelter.

5. The extendible shelter of claim 1, further comprising a fixed outer access structure, said outer access structure being of similar size and shape to said outermost frame end and attachable to a ground surface, said outer access structure having an outer access aperture, said frame and said covers being sized and shaped, and said outer access structure positioned, such that said shelter can be extended to said outer access structure and connected thereto.

6. The extendible shelter of claim 1, wherein said side support sections comprise a plurality of substantially vertical respective side support connected to one another by respective side cross support members.

7. The extendible shelter of claim 6, wherein at least one side support member is configured for mounting of a respective wheel therefore at a respective bottom end of said side support member.

8. The extendible shelter of claim 7, further comprising, for each wheel, at least one respective anchor affixable to a ground surface over which said shelter extends, said wheel being releasably securable to said anchor, said anchor releasably anchoring said wheel, and thereby said side support member having said wheel mounted thereon, in fixed position relative said ground surface when said wheel is connected thereto.

9. The extendible shelter of claim 8, wherein said side support sections have at least one generally aligned member pair of said side support members, one on each side support section, with a respective wheel pair of said respective wheels mounted thereon, said extendible shelter further comprising for each said wheel pair, an anchor pair of generally aligned said wheel anchors for releasably anchoring said wheels of said wheel pair when secured therein.

10. The extendible shelter of claim 8, wherein said member pair is situated at said outermost end of said frame.

11. The extendible shelter of claim 8, said wheel anchor comprising an anchor base, affixable to the ground surface, and a wheel anchor lock in which said wheel is releasably securable, said wheel anchor lock being releasably connectable to said anchor base with said wheel secured therein to anchor said wheel.

12. The extendible shelter of claim 11, wherein said wheel anchor lock comprises a base plate releasably connectable to said anchor base, and first and second side plates connected to said base plate at first and second base plate ends thereof, said side plates being releasably connectable to said support member in which said wheel is mounted with said wheel seated on said base plate intermediate said side plates to releasably secure said wheel within said wheel anchor lock.

13. The extendible shelter of claim 12, wherein each side plate comprises a respective plate securing aperture and said support member comprises generally opposed and axially aligned member securing apertures, said respective member securing apertures and said plate securing apertures being axially aligned when said wheel is placed on said base plate, said anchor further comprising a securing member removably insertable into said plate and member securing apertures to releasably connect said side plates to said support member and secure said wheel within said wheel anchor lock.

14. The extendible shelter of claim 13, wherein said side plates are pivotally connected to said plate ends, said side plates being pivotable relative said base plate to axially align said plate securing apertures with said respective member securing apertures.

15. The extendible shelter of claim 13, wherein said anchor base comprises a socket base and a socket extending generally perpendicularly away therefrom and said anchor lock comprises a locking member extending generally perpendicularly from said base plate, said locking member being releasably insertable into said socket to releasably connect said wheel anchor lock to said anchor base.

16. The extendible shelter of claim 15, said socket comprising at least one L-shaped slot formed in an inner wall thereof, said slot having an upper portion axially aligned with said socket and extending from a mouth of the socket and an intersecting lower portion extending generally perpendicularly from the upper portion, said locking member comprising, for each slot, at least one respective notch protruding therefrom, said locking member being insertable into said socket through said mouth with said respective notch engaged in said slot and rotatable within the socket to extend said notch into said lower portion to releasably lock said locking member in said socket.

17. The extendible shelter of claim 7, wherein said side cross support members are movable outwardly away from and inwardly towards said building to provide, respectively, extension and retraction of said frame and said covers.

18. The extendible shelter of claim 17, wherein said roof support section comprises a plurality of roof support members, extending between said side sections and connected to said side support members, and a plurality of roof cross support members connecting said roof support members to one another, said roof cross support members being movable outwardly away from and inwardly towards said building during extension and retraction of said frame.

* * * * *